US008257143B2

(12) United States Patent
Katsuoka et al.

(10) Patent No.: US 8,257,143 B2
(45) Date of Patent: Sep. 4, 2012

(54) METHOD AND APPARATUS FOR POLISHING OBJECT

(75) Inventors: Seiji Katsuoka, Tokyo (JP); Manabu Tsujimura, Tokyo (JP)

(73) Assignee: Ebara Corporation, Tokyo (JP)

( * ) Notice: Subject to any disclaimer, the term of this patent is extended or adjusted under 35 U.S.C. 154(b) by 828 days.

(21) Appl. No.: 12/320,976

(22) Filed: Feb. 10, 2009

(65) Prior Publication Data

US 2009/0209176 A1 Aug. 20, 2009

(30) Foreign Application Priority Data

Feb. 14, 2008 (JP) ..... 2008-032928

(51) Int. Cl.
*B24B 49/00* (2012.01)

(52) U.S. Cl. ..... 451/8; 451/57; 451/41

(58) Field of Classification Search ..... 451/57, 451/58, 59, 287, 288, 289, 41, 8
See application file for complete search history.

(56) References Cited

U.S. PATENT DOCUMENTS

| | | | | |
|---|---|---|---|---|
| 5,931,722 | A | 8/1999 | Ohmi et al. | |
| 6,165,056 | A | 12/2000 | Hayashi et al. | |
| 6,332,826 | B1 | 12/2001 | Katsuoka et al. | |
| 6,391,780 | B1 | 5/2002 | Shih et al. | |
| 6,435,949 | B1 | 8/2002 | Katsuoka et al. | |
| 6,561,881 | B2 * | 5/2003 | Jeong | 451/57 |
| 6,709,316 | B1 | 3/2004 | Sun et al. | |
| 6,857,950 | B2 | 2/2005 | Hayashi et al. | |
| 2002/0025764 | A1 | 2/2002 | Katsuoka et al. | |
| 2002/0124373 | A1 | 9/2002 | Katsuoka et al. | |
| 2003/0168169 | A1 | 9/2003 | Ishikawa et al. | |
| 2005/0227596 | A1 | 10/2005 | Katsuoka et al. | |
| 2006/0223421 | A1 | 10/2006 | Miyashita et al. | |

FOREIGN PATENT DOCUMENTS

| | | |
|---|---|---|
| GB | 2 331 948 | 6/1999 |
| JP | 07-029223 | 1/1995 |
| JP | 07-052033 | 2/1995 |
| JP | 07-088759 | 4/1995 |
| JP | 09-117857 | 5/1997 |
| JP | 09-277160 | 10/1997 |
| JP | 11-156711 | 6/1999 |
| JP | 11-156712 | 6/1999 |
| JP | 11-162893 | 6/1999 |
| JP | 2000-000757 | 1/2000 |

(Continued)

*Primary Examiner* — Robert Rose
(74) *Attorney, Agent, or Firm* — Wenderoth, Lind & Ponack, L.L.P.

(57) ABSTRACT

A method can effectively eliminate a surface level difference (irregularities) in a film formed on an object without producing scratches in a surface of the film, and can polish and remove the film into a flat surface with greatly increased productivity. The method comprises carrying out a first polishing step by pressing a polishing pad of a polishing device, having a diameter which is smaller than the radius of the object, against the surface of the object at a first pressure while moving the polishing pad and the object relative to each other at a first relative speed. The first polishing step is terminated at a point in time when a surface level difference in the object is eliminated to a targeted level. The method further comprises carrying out a second polishing step by pressing a polishing pad of a polishing device, having a diameter which is larger than the diameter of the object, against the surface of the object at a second pressure while moving the polishing pad and the object relative to each other at a second relative speed.

8 Claims, 8 Drawing Sheets

FOREIGN PATENT DOCUMENTS

| | | |
|---|---|---|
| JP | 2000-127032 | 5/2000 |
| JP | 2000-158325 | 6/2000 |
| JP | 2000-315665 | 11/2000 |
| JP | 2000-317820 | 11/2000 |
| JP | 2001-009701 | 1/2001 |
| JP | 2001-179605 | 7/2001 |
| JP | 2004-179588 | 6/2004 |

* cited by examiner

METHOD AND APPARATUS FOR POLISHING OBJECT

BACKGROUND OF THE INVENTION

1. Field of the Invention

The present invention relates to a method for polishing a surface (surface to be polished) of an object, such as a semiconductor wafer, into a flat mirror surface, and more particularly to a method and an apparatus for polishing an object, which are useful for polishing and removing an extra metal interconnect material other than that embedded in trenches in a damascene interconnect formation process for a semiconductor device.

2. Description of the Related Art

For the formation of interconnects of a semiconductor device, a so-called damascene process is currently used which involves filling, by plating, a metal interconnect material (conductive material) such as aluminum, or more recently copper or silver, into trenches or contact holes previously formed in an insulating film (interlevel dielectric film), and then removing an excess of the metal interconnect material by chemical mechanical polishing (hereinafter abbreviated as "CMP").

FIG. 1 illustrates an exemplary damascene process for forming copper interconnects. First, fine trenches 202*a* having a small width and wide trenches 202*b* having a wide width are formed in an insulating film (interlevel dielectric film) 200 of, e.g., $SiO_2$ or a low-k material, deposited on a surface of a substrate W such as a semiconductor substrate, and then a barrier metal layer 204 of, e.g., TaN is formed on an entire surface of the substrate. Thereafter, a seed layer (not shown), which serves as a feeding layer during electroplating, is formed on a surface of the barrier metal layer 204, as necessary. Next, copper plating of the substrate surface is carried to form a copper film 206 on the surface of the substrate W, thereby filling the copper film 206 into the trenches 202*a*, 202*b*. Thereafter, an extra copper film 206 and barrier metal layer 204 on the insulating film 200 are removed by chemical mechanical polishing (CMP) into a flattened surface, thereby forming fine interconnects 208*a* and wide interconnects 208*b*, composed of copper, in the insulating film 200, as shown in FIG. 8D.

In the formation of the copper film 206 by copper plating on the surface of the substrate W where the fine trenches 202*a* and the wide trenches 202*b* are co-present, plating tends to be promoted whereby the copper film 206 becomes raised over a fine trench 202*a*, whereas promoted growth of copper does not occur in a wide trench 202*b* whereby the copper film 206 becomes recessed over the wide trench 202*b*. As a result, as shown in FIG. 1, a surface level difference (irregularities) $H_1$, which is the sum of the height of the raised portion (mounding) over the fine trench 202*a* and the depth of the recessed portion (dishing) over the wide trench 202*b*, is produced in the copper film 206 formed on the substrate W.

Though the surface level difference (irregularities) $H_1$ in the copper film 206 after plating gradually decreases as polishing of the copper film 206 by CMP progresses, a level difference $H_2$ remains in the recessed portion (dishing), corresponding to the wide trench 202*b*, of the surface of the copper film 206, as shown in FIG. 2. It is generally difficult to eliminate the level difference $H_2$. Accordingly, when removing the extra copper film 206 and barrier metal layer 204 on the insulating film 200 to form the fine interconnects 208*a* and the wide interconnects 208*b*, dishing (over-polishing) will occur in the surfaces of the wide interconnects 208*b*.

Such dishing is influenced by the elasticity of a polishing pad and the polishing pressure applied during CMP. A polishing pad, whose surface is roughened by a diamond-electrodeposited dresser, is generally used in CMP in order to maintain a constant polishing rate. A polishing liquid (slurry) containing an abrasive is allowed to intrude into recesses of the roughened surface of such a dressed polishing pad upon CMP. A film of metal interconnect material such as the copper film 206, deposited in excess, can be polished away by pressing the polishing pad, with the polishing liquid held on the surface, against the film of metal interconnect material formed on an object, such as a substrate. However, the polishing pad having the roughened surface can easily enter the recessed portions of the film of metal interconnect material, such as the copper film 206, having a surface level difference (irregularities), whereby not only the surfaces of raised portions but also the bottoms of recessed portions can be polished. Accordingly, though the surface level difference may be reduced, it will not be eliminated.

In order to reduce a surface level difference (irregularities) in an object film, such as a film of metal interconnect material, as much as possible by CMP, it is conceivable to polish only the surfaces of raised portions of the object film without polishing the bottoms of recessed portions. To this end, it may be considered to use a most rigid polishing pad so that the polishing pad will make contact with only raised portions of the object film and not with the bottoms of recessed portions. In this regard, it is known to use a rigid single-layer polishing pad instead of a two-layer polishing pad (upper layer: rigid polishing pad, lower layer: an elastic material such as polyurethane foam) commonly used in CMP.

It is also known that a surface level difference in an object film, such as a film of metal interconnect material, can be reduced by not using a polishing pad but using a so-called fixed abrasive, comprising abrasive grains of, e.g., cerium oxide ($CeO_2$) fixed in a binder such as a phenol resin, in carrying out polishing of the film (see Japanese Patent Laid-Open Publication No. 2000-315665).

SUMMARY OF THE INVENTION

When a rigid single-layer polishing pad is used in CMP, polishing will not proceed smoothly because the polishing pad hardly follows a surface of an object to be polished. In addition, because the surface of the polishing pad is roughened by a diamond dresser, the roughened surface of the polishing pad may make contact with and polish the bottoms of recessed portions of the object film. On the other hand, the use of a fixed abrasive is effective in the reduction of a surface level difference in an object film since the abrasive grains make contact with only raised portions of the film. However, the use of a fixed abrasive in polishing is likely to produce scratches in the polished surface of the object.

The present invention has been made in view of the above situation in the related art. It is therefore an objective of the present invention to provide a method and an apparatus for polishing a object, which can effectively eliminate a surface level difference, or irregularities, in a film formed on an object, or substrate, to a targeted level, without producing scratches in the surface, and can polish and remove the film of the object into a flat surface with increased productivity.

In order to achieve the objective, one embodiment of the present invention provides a method for polishing an object by pressing a polishing pad against a surface of the object while moving the polishing pad and the object relative to each other. The method comprises carrying out a first polishing step by pressing a polishing pad of a polishing device against the surface of the object at a first pressure while moving the polishing pad and the object relative to each other at a first relative speed, wherein the polishing pad used in the first polishing step has a diameter which is smaller than the radius of the object; carrying out a termination step of terminating said first polishing step at a point of time when a surface level difference in the object is eliminated to a targeted level; and carrying out a second polishing step by pressing a polishing pad of a polishing device against the surface of the object at a second pressure which is different from the first pressure while moving the polishing pad and the object relative to each other at a second relative speed which is different from the first relative speed, wherein the polishing pad used in the second polishing step has a diameter which is larger than the diameter of the object.

By thus carrying out the first polishing step for an object by pressing a polishing pad of a polishing device, having a diameter which is smaller than the radius of the object, against the surface to be polished of the object at a first pressure while moving the polishing pad and the object relative to each other at a first relative speed, it becomes possible to carry out polishing with using, e.g., a polishing pad comprising two layers as the polishing pad, in such a manner that the pressure of the polishing pad on the object is made low (low pressure) so that the polishing pad will hardly make contact with recessed portions of the object film, and that the pressure of the polishing pad on a small area of the object is controlled with precision, thereby effectively eliminating a surface level difference (irregularities) in the object to a targeted level. The first polishing step is low in the polishing rate and thus poor in the productivity even when using a high relative speed between the polishing pad and the object. Therefore, the first polishing step is terminated upon detection of a point in time when a surface level difference in the object is eliminated to a targeted level, e.g., when a surface level difference in the object becomes, e.g., 5-20 nm in a so-called BPSG (Boron Phosphor Silicate Grass) process (65 nm node) or when a surface level difference in the object becomes, e.g., 30-60 nm in a so-called copper damascene process, followed by the second polishing step. The second polishing step is carried out by pressing a polishing pad of a polishing device, having a diameter which is larger than the diameter of the object, against the surface to be polished of the object at a second pressure which is different from, preferably larger than, the first pressure while moving the polishing pad and the object relative to each other at a second relative speed which is different from, preferably slower than, the first relative speed. The second polishing step can be performed at a higher polishing rate with an increased productivity while maintaining the flatness of the object film being polished and effectively supplying a polishing liquid (slurry) between the polishing pad and the surface to be polished.

The point in time when the surface level difference in the object is eliminated to a targeted level can be detected based on measured values of an eddy current sensor provided in the polishing device for carrying out the first polishing step.

When a thickness of a film formed on the object is measured with an eddy current sensor, the measured thickness greatly changes until the polishing pad comes into full contact with the film, whereas the measured thickness of the film changes according to the polishing amount when the polishing pad is in full contact with the film. The time of elimination of a surface level difference in the object can therefore be detected by detecting the shift in the change of the measured thickness.

The point in time when the surface level difference in the object is eliminated to a targeted level may also be detected based on a change in a torque that rotates the polishing device for carrying out the first polishing step.

In polishing of an object having a surface level difference (irregularities), the torque gradually increases from the start of polishing until the polishing pad comes into full contact with the object, whereas there is no change in the torque after the full contact of the polishing pad with the object. The point in time when the surface level difference in the object is eliminated and the surface of the object becomes flat can therefore be detected by detecting the change in the torque.

The present invention also provides an apparatus for polishing an object including a first polishing unit having a polishing device having a diameter which is smaller than the radius of the object. The first polishing unit is capable of carrying out a first polishing step of pressing a polishing pad of the polishing device against the surface of the object at a first pressure while moving the polishing pad and the object relative to each other at a first relative speed. The apparatus further comprises a detecting instrument for detecting a point in time when a surface level difference of the object is eliminated to a targeted level, and a second polishing unit having a polishing device having a diameter which is larger than the diameter of the object. The second polishing unit is capable of carrying out a second polishing step of pressing a polishing pad of the polishing device against the surface of the object at a second pressure which is different from the first pressure while moving the polishing pad and the object relative to each other at a second relative speed which is different from the first relative speed.

The detecting instrument is, for example, an eddy current sensor or a torque sensor.

According to the present invention, a surface level difference (irregularities) in an object can be effectively eliminated by the first polishing step, and the object can be polished at a higher polishing rate with an increased productivity while maintaining the flatness of the object being polished by the second polishing step. Thus, by utilizing the respective advantages of the two polishing steps and making them compensate for each other's disadvantages, it becomes possible to form interconnects having a flat surface with good productivity without the formation of scratches or dishing in the polished surface.

DETAILED DESCRIPTION OF THE PREFERRED EMBODIMENTS

Figure 1:
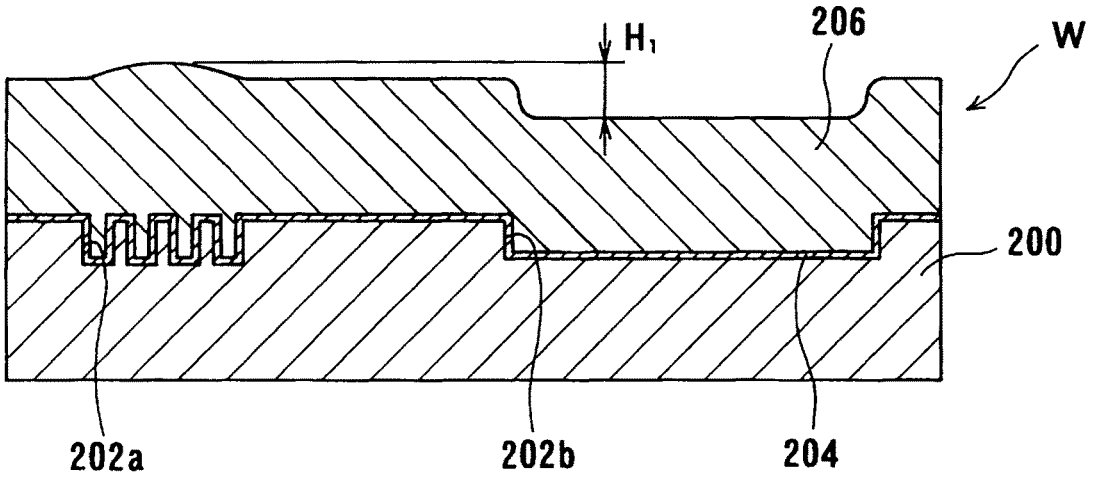
FIG. 1 is a cross-sectional diagram illustrating a copper film, a metal interconnect material, as formed on a surface of a substrate in a damascene process.
Figure 2:
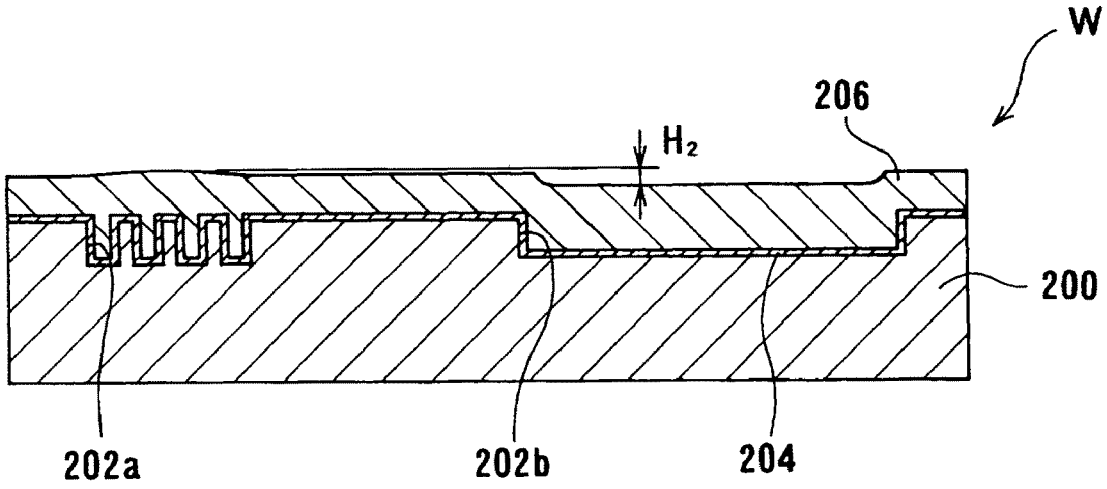
FIG. 2 is a cross-sectional diagram illustrating the copper film of FIG. 1 in the course of its polishing by CMP.
Figure 8A:
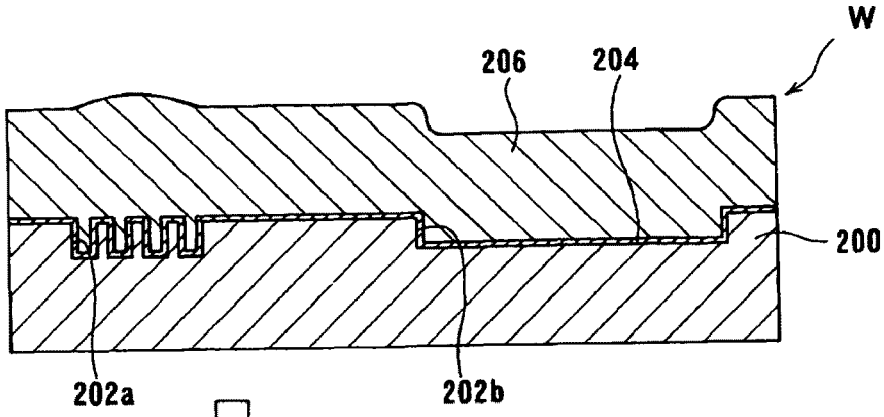
FIGS. 8A through 8D are diagrams illustrating a process for forming copper interconnects by the polishing apparatus shown in FIG. 3.

Preferred embodiments of the present invention will now be described with reference to the drawings. The following description illustrates a polishing apparatus and a polishing method which are adapted to carry out a process which comprises providing a substrate (object) W, as shown in FIG. 1, having in its surface a copper film (metal interconnect material) 206 as an object film, and polishing and removing the surface copper film 206 and an underlying barrier metal layer 204, thereby forming copper interconnects 208*a*, 208*b*, as shown in FIG. 8D.

Figure 3:
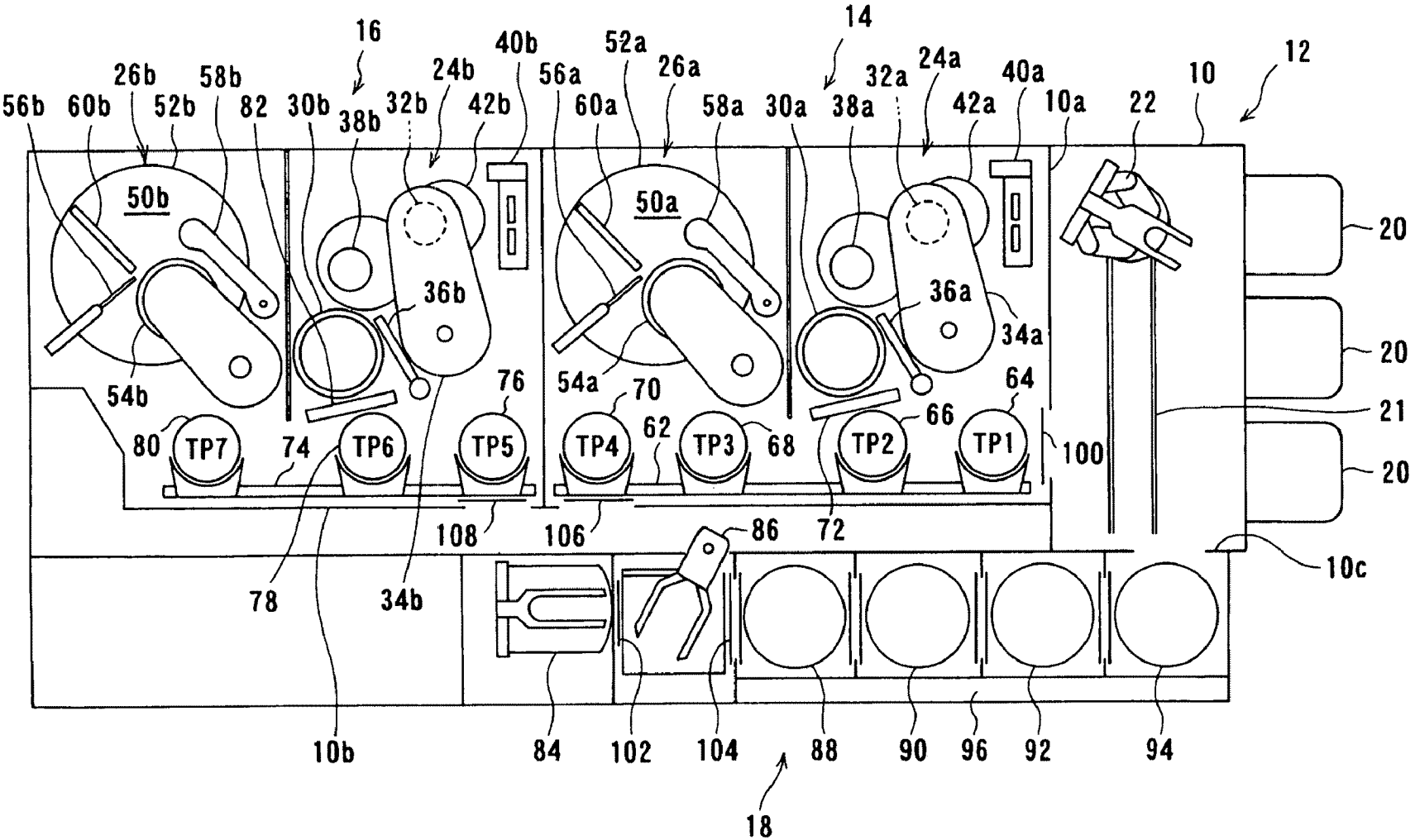
FIG. 3 is a plan view showing the overall construction of a polishing apparatus according to an embodiment of the present invention.

FIG. 3 is a plan view showing the overall construction of a polishing apparatus according to an embodiment of the present invention. As shown in FIG. 3, the polishing apparatus of the present embodiment has a housing 10 in a substantially rectangular form. An interior space of the housing 10 is divided into a loading/unloading section 12, two units of two-step polishing units 14, 16, and a cleaning section 18 by partition walls 10*a*, 10*b*, and 10*c*. The loading/unloading section 12, the two-step polishing units 14, 16, and the cleaning section 18 are assembled independently of each other, and air is discharged from these sections and units independently of each other.

The loading/unloading section 12 has two or more front loading portions 20 (three in FIG. 3) on which substrate cassettes, each storing a number of substrates therein, are placed. The front loading portions 20 are arranged adjacent to each other along a width direction of the polishing apparatus (a direction perpendicular to a longitudinal direction of the polishing system). Each of the front loading portions 20 can receive thereon an open cassette, an SMIF (Standard Manufacturing Interface) pod, or a FOUP (Front Opening Unified Pod). The SMIF and FOUP are a hermetically sealed container which houses a substrate cassette therein and covers it with a partition wall to provide an interior environment isolated from an external space.

The loading/unloading section 12 has a moving mechanism 21 extending along an arrangement direction of the front loading portions 20. A first transfer robot 22 as a first transfer mechanism is installed on the moving mechanism 21 and is movable along the arrangement direction of the front loading portions 20. The first transfer robot 22 is operable to move on the moving mechanism 21 so as to access the substrates of the substrate cassettes mounted on the front loading portions 20. This first transfer robot 22 has vertically arranged two hands, which are separately used. For example, an upper hand can be used for returning a polished substrate to the substrate cassette, and a lower hand can be used for transferring a non-polished substrate.

The loading/unloading section 12 is required to be a cleanest area. Therefore, pressure in the interior of the loading/unloading section 12 is kept higher at all times than pressures in the exterior space of the apparatus, the two units of two-step polishing units 14, 16 and the cleaning section 18, respectively. Further, a filter fan unit (not shown in the drawings) having a clean air filter, such as HEPA filter or ULPA filter, is provided above the moving mechanism 21 of the first transfer robot 22. This filter fan unit removes particles, toxic vapor, and toxic gas from air to produce clean air, and forms a downward flow of the clean air at all times.

This embodiment employs the two units of two-step polishing units 14, 16 capable of carrying out parallel processing of two substrates. The two-step polishing unit 14 is a unit in which the first polishing step and the second polishing step of a substrate are carried out; and a first polishing unit 24*a* for carrying out the first polishing step and a second polishing unit 26*a* for carrying out the second polishing step are housed in the two-step polishing unit 14. Similarly, a first polishing unit 24*b* for carrying out the first polishing step and a second polishing unit 26*b* for carrying out the second polishing step are housed in the two-step polishing unit 16.

The first polishing unit 24*a* of the two-step polishing unit 14 includes a rotatable substrate table 30*a* for holding a substrate with its front surface facing upwardly, a pivotable and vertically-movable polishing head 34*a* for pressing a polishing device 32*a*, having a diameter which is smaller than the radius of the substrate, against the substrate held on the substrate table 30*a* to polish the substrate, and a rinsing nozzle 36*a* for supplying a rinsing liquid for rinsing to the substrate held on the substrate table 30*a*. A polishing pad 124 is attached to a surface (lower surface) of the polishing device 32*a* as will be described below. The first polishing unit 24*a* also includes a dresser 38*a* for dressing the polishing pad 124, a polishing pad profile measuring device 40*a* for measuring the surface profile of the polishing pad 124, and a polishing pad replacement stage 42*a*.

Similarly, the first polishing unit 24*b* of the two-step polishing unit 16 includes a substrate table 30*b*, a polishing head 34*b* for pressing a polishing device 32*b* against a substrate held on the substrate table 30*b* to polish the substrate, a rinsing nozzle 36*b*, a dresser 38*b*, a polishing pad profile measuring device 40*b*, and a polishing pad replacement stage 42*b*.

The second polishing unit 26*a* of the two-step polishing unit 14, capable of being used in a secondary polishing process in the first polishing unit 26*a*, includes a polishing device (second polishing device) 52*a* having a diameter which is larger than the diameter of the substrate and having a polishing pad 50*a* attached thereto, which is larger than the substrate in size of diameter, a top ring 54*a* for holding the substrate and pressing the substrate against the polishing pad 50*a* to polish the substrate, a polishing liquid supply nozzle 56*a* for supplying a polishing liquid or a dressing liquid (e.g., water) to the polishing pad 50*a*, a dresser 58*a* for carrying out dressing of the polishing pad 50*a*, and an atomizer 60*a* for spraying a misty mixed fluid of a liquid (e.g., pure water) and a gas (e.g., nitrogen gas) to the polishing surface from one or more nozzles.

Similarly, the second polishing unit 26*b* of the two-step polishing unit 16, capable of being used in a secondary polishing process in the second polishing unit 26*b*, includes a polishing device 52*b* having a polishing pad 50*b* attached thereto (polishing pad is detachable when maintenance), a top ring 54*b*, a polishing liquid supply nozzle 56*b*, a dresser 58*b*, and an atomizer 60*b*.

A first linear transporter 62 as a second (linear) transfer mechanism is provided between the two-step polishing unit 14 and the cleaning section 18. This first linear transporter 62 is configured to transfer a substrate between four transferring positions located along the longitudinal direction of the polishing apparatus (hereinafter, these four transferring positions will be referred to as a first transferring position TP1, a second transferring position TP2, a third transferring position TP3, and a fourth transferring position TP4 in the order from the loading/unloading section 12). A lifer 64 for lifting a substrate transferred from the first transfer robot 22 in the loading/unloading section 12 is disposed below the first transferring position TP1 of the first linear transporter 62. A vertically movable pusher 66 is disposed below the second transferring position TP2, a vertically movable pusher 68 is disposed below the third transferring position TP3, and a vertically movable lifter 70 is disposed below the fourth transferring position TP4. A reversing/transferring machine 72 for reversing and transferring a substrate is disposed between the pusher 66 and the substrate table 30*a*.

In the two-step polishing unit 16, a second linear transporter 74 as a second (linear) transfer mechanism is provided next to the first linear transporter 62. This second linear transporter 74 is configured to transfer a substrate between three transferring positions located along the longitudinal direction of the polishing apparatus (hereinafter, these three transferring positions will be referred to as a fifth transferring position TP5, a sixth transferring position TP6, and a seventh transferring position TP7 in the order from the loading/unloading section 12). A vertically movable lifter 76 is disposed below the fifth transferring position TP5 of the second linear transporter 74, a pusher 78 is disposed below the sixth transferring position TP6, and a pusher 80 is disposed below the seventh transferring position TP7. A reversing/transferring machine 82 for reversing and transferring a substrate is disposed between the pusher 78 and the substrate table 30*b*.

The cleaning section 18 is an area where a polished substrate is cleaned. The cleaning section 18 includes a second transfer robot 84, a reversing machine 86 for reversing a substrate received from the second transfer robot 84, four cleaning devices 88, 90, 92, and 94 for cleaning a polished substrate, and a transfer unit 96 as a third transfer mechanism for transferring a substrate between the reversing machine 86 and the cleaning devices 88, 90, 92, and 94. The second transfer robot 84, the reversing machine 86, and the cleaning devices 88, 90, 92, and 94 are arranged in series along the longitudinal direction of the polishing apparatus. A filter fan unit (not shown in the drawings), having a clean air filter, is provided above the cleaning devices 88, 90, 92, and 94. This filter fan unit is configured to remove particles from an air to produce a clean air, and to form downward flow of the clean air at all times. Pressure in the interior of the cleaning section 18 is kept higher than pressure in the two-step polishing units 14, 16, so that particles in the two-step polishing units 14, 16 is prevented from flowing into the cleaning section 18.

The primary cleaning device 88 and the secondary cleaning device 90 may comprise, for example, a roll type cleaning device having upper and lower roll-shaped sponges which are rotated and pressed against front and rear surfaces of a substrate to thereby clean the front and rear surfaces of the substrate. The tertiary cleaning device 92 may comprise, for example, a pencil type cleaning device having a hemispherical sponge which is rotated and pressed against a substrate to clean the substrate. The quaternary cleaning device 94 may comprise, for example, a pencil type cleaning device which rinses a reverse side of a substrate and rotates and presses a hemispherical sponge against a front side of the substrate to clean the substrate. The quaternary cleaning device 94 has a stage for rotating a chucked substrate at a high rotational speed, and thus has a function (spin-drying function) to dry a cleaned substrate by rotating a substrate at a high rotational speed. In the cleaning devices 88, 90, 92, and 94, a megasonic type cleaning device which applies ultrasonic waves to a cleaning liquid to clean a substrate may be provided in addition to the roll type cleaning device or the pencil type cleaning device described above.

The transfer unit 96 of the cleaning section 18 transfers substrates simultaneously from the reversing machine 86 to the primary cleaning device 88, from the primary cleaning device 88 to the secondary cleaning device 90, from the secondary cleaning device 90 to the tertiary cleaning device 92, and from the tertiary cleaning device 92 to the quaternary cleaning device 94, respectively.

A shutter 100 is provided between the first transfer robot 22 and the lifter 64. When transferring a substrate, the shutter 100 is opened, and the substrate is delivered between the first transfer robot 22 and the lifter 64. Shutters 102, 104, 106, and 108 are also provided between the reversing machine 86 and the second transfer robot 84, between the reversing machine 86 and the primary cleaning device 88, between the two-step polishing unit 14 and the second transfer robot 84, and between the two-step polishing unit 16 and the second transfer robot 84, respectively. These shutters 102, 104, 106, and 108 are opened when a substrate is transferred between the reversing machine 86 and the second transfer robot 84 or between the reversing machine 86 and the primary cleaning device 88. When a substrate is not transferred, the shutters 102, 104, 106, and 108 are closed.

Figure 4:
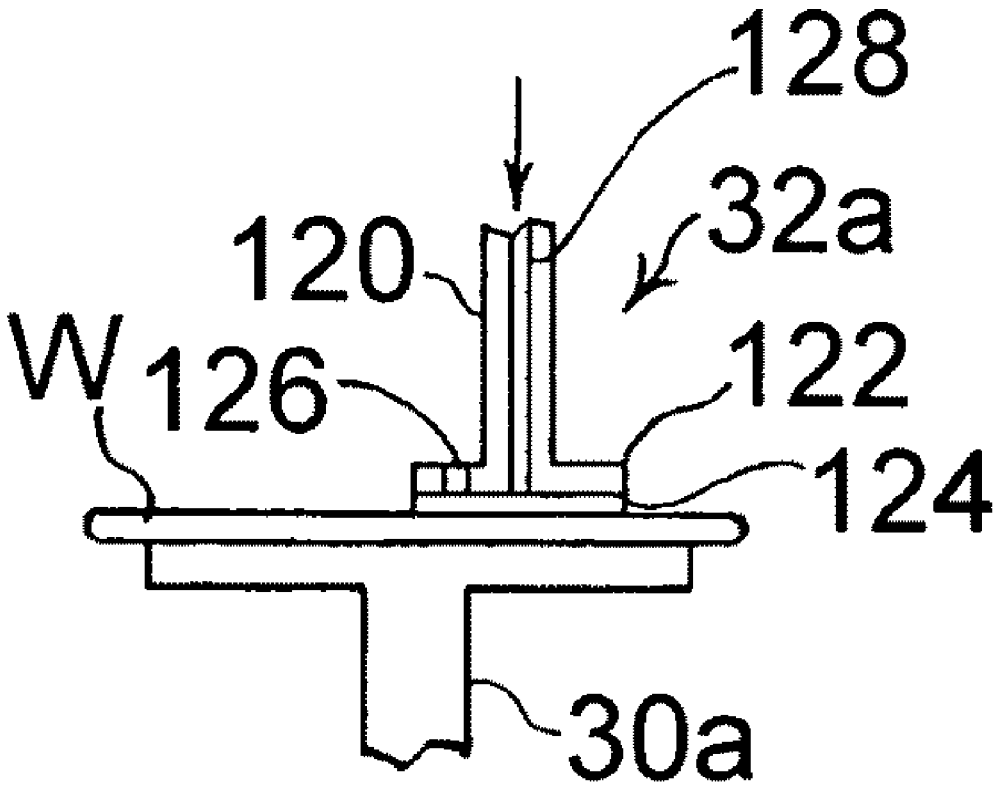
FIG. 4 is a schematic cross-sectional view showing a polishing table and a polishing device provided in a first polishing unit of a two-step polishing unit of the polishing apparatus shown in FIG. 3.
Figure 5:
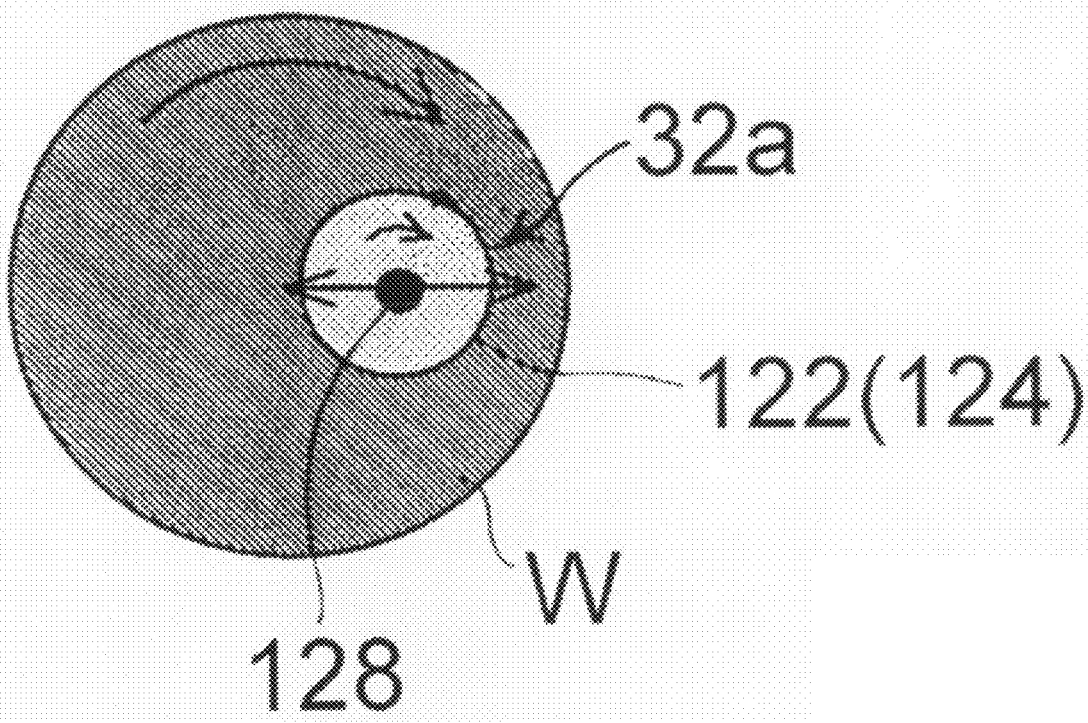
FIG. 5 is a schematic plan view of the polishing table and the polishing device, shown in FIG. 4.

The substrate table 30*a* and the polishing device 32*a*, provided in the first polishing unit 24*a* of the two-step polishing unit 14, will now be described with reference to FIGS. 4 and 5. The first polishing unit 24*b* of the two-step polishing unit 16 has the same construction as that described hereinafter.

The substrate table 30*a* of the first polishing unit 24*a* is designed to hold, e.g., by attraction, a substrate W with its front surface facing upwardly. The polishing device 32*a* is comprised of a rotary support 122 coupled to a lower end of a rotatable polishing section drive shaft 120, and a polishing pad 124 attached to a surface (lower surface) of the rotary support 122. In the interior of the rotary support 122 is provided an eddy current sensor 126 as a detecting instrument for detecting a point in time when a surface level difference in a copper film 206, formed in the surface of the substrate W, is eliminated to a targeted level or the film surface becomes flat. With use of the present invention, it is advantageous to flatten the film on the substrate W to a targeted level whereas the film having a thickness remains on the substrate. A polishing liquid supply section 128 for supplying a polishing liquid between the polishing pad 124 and the substrate W held on the substrate table 30*a* is provided centrally in the interiors of the polishing section drive shaft 120 and the rotary support 122. When dressing the polishing pad 124 with the dresser 38*a*, a dressing liquid (e.g., water) is supplied from the polishing liquid supply section 128 to between the polishing pad 124 and the dresser 38*a*.

In this embodiment, in operation of the first polishing unit 24*a*, the substrate W is first held with its front surface (surface to be polished) facing upwardly on the substrate table 30*a*. The substrate W is then rotated by rotating the substrate table 30*a*, and the polishing table 32*a* being rotated is lowered to press the polishing a pad 124 of the polishing device 32*a* against the substrate W at a predetermined pressure, while at the same time a polishing liquid is supplied from the polishing liquid supply section 128 to between the substrate W and the polishing pad 124, thereby polishing the copper film 206 as an object film formed in the surface to be polished of the substrate W. During the polishing, the polishing device 32*a* is pivoted along the radial direction of the substrate W so as to polish the entire surface of the substrate W. It is advantageous to hold a substrate facing upwardly on a substrate table 30*a* because it is possible to flatten a surface of the substrate accurately and detect a progress of an elimination of a surface level difference of the substrate in a precise and accurate manner especially when the substrate has a large diameter.

Figure 6:
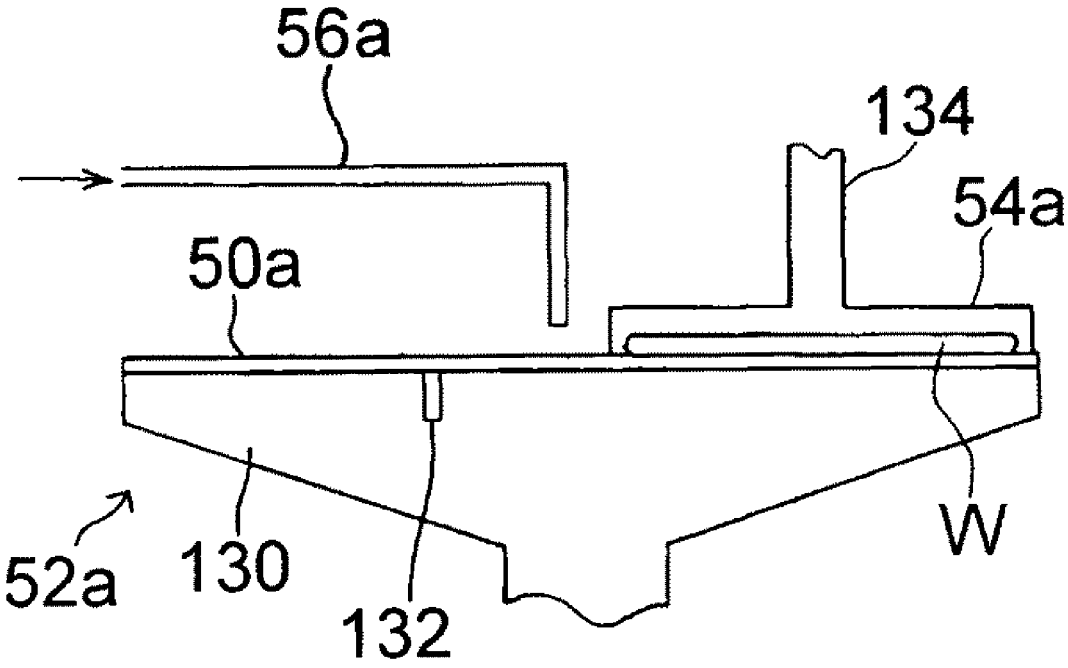
FIG. 6 is a schematic cross-sectional view showing a polishing device and a top ring, provided in a second polishing unit of the two-step polishing unit of the polishing apparatus shown in FIG. 3.
Figure 7:
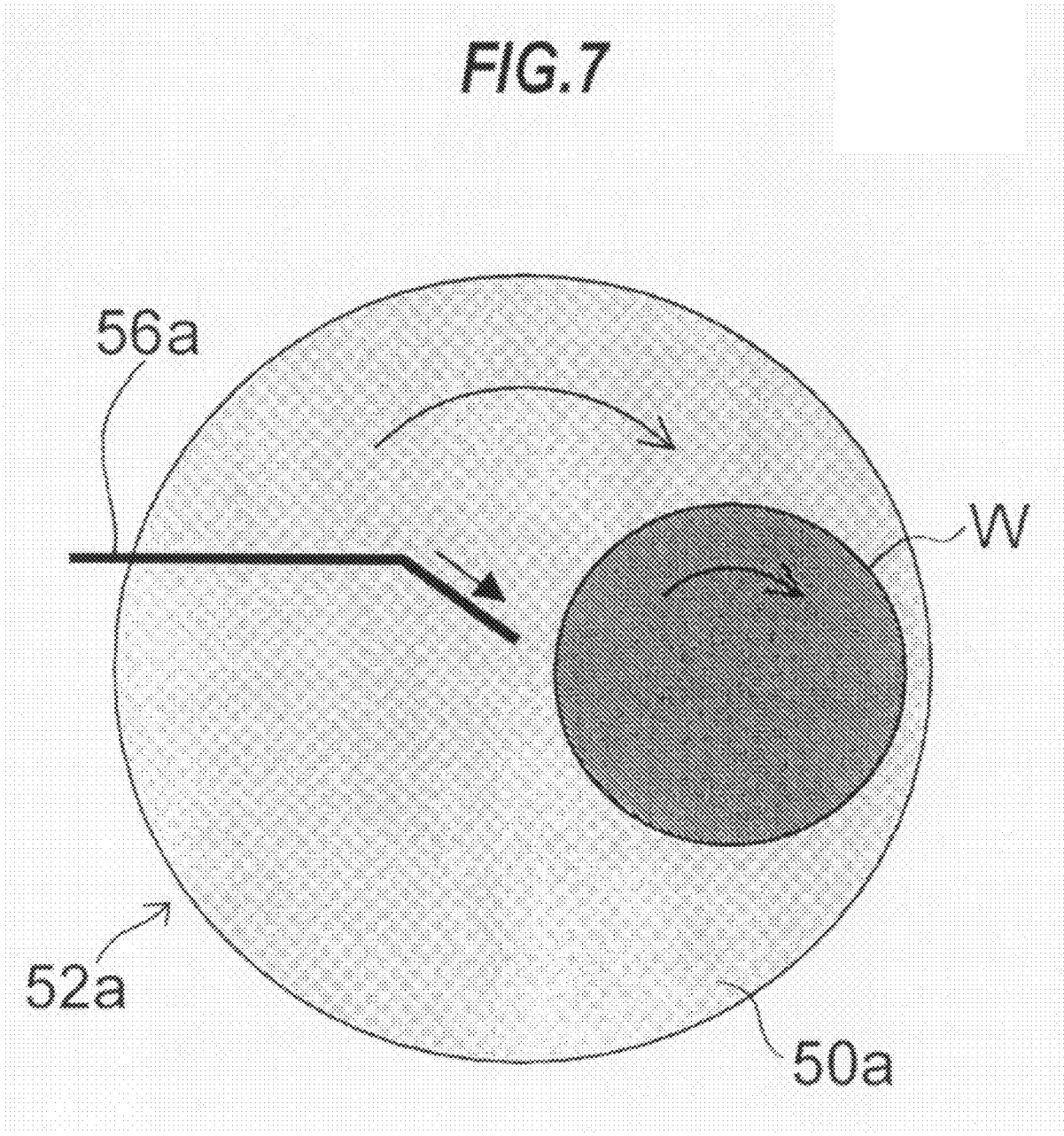
FIG. 7 is a schematic plan view of the polishing device and the top ring, shown in FIG. 6.

The polishing device 52*a* and the top ring 54*a*, provided in the second polishing unit 26*a* of the two-step polishing unit 14, will now be described with reference to FIGS. 6 and 7. The second polishing unit 26*b* of the two-step polishing unit 16 has the same construction as that described hereinafter.

The polishing device 52*a* is comprised of a rotatable turntable 130, and a polishing pad 50*a* attached to an upper surface of the turntable 130. In the interior of the turntable 130 is provided an eddy current sensor 132 as a detecting instrument for detecting removal by polishing of the extra copper film 206 and barrier metal layer 204 formed in the surface of the substrate W. The top ring 54*a* is coupled to a lower end of a rotatable and vertically-movable top ring drive shaft 134.

In operation of the second polishing unit 26*a*, the substrate W is held with its front surface (surface to be polished) facing downwardly by the top ring 54*a*. The turntable 130 is then rotated, and the top ring 54*a* being rotated is lowered to press the substrate W against the polishing pad 50*a* of the polishing device 52*a*, while at the same time a polishing liquid is supplied from the polishing liquid supply nozzle 56*a* to the polishing pad 50*a*, thereby polishing the copper film 206 and the barrier metal layer 204 as object films formed in the surface to be polished of the substrate W.

The operation of the polishing apparatus having the above construction will now be described.

The polishing apparatus is designed to carry out parallel processing of two substrates. One substrate is taken by the first transfer robot 22 out of a substrate cassette mounted in one of the front loading portions 20, and the substrate is transported by the first linear transporter 62 to the substrate table 30*a* of the first polishing unit 24*a* of the two-step polishing unit 14 and held on the substrate table 30*a*. The first polishing step of the substrate is carried out in the first polishing unit 24*a*. The substrate after the first polishing step is reversed by the reversing/transferring machine 72 and placed on the pusher 66, and the substrate is then transported by the first linear transporter 62 to the top ring 54*a* of the second polishing unit 26*a* of the two-step polishing unit 14 and held by the top ring 54*a*. The second polishing step of the substrate is carried out in the second polishing unit 26*a*. The substrate after the second polishing step is transported by the first linear transporter 62 and the second transfer robot 84 to the reversing machine 86, where the substrate is reversed. The reversed substrate is transported to the primary cleaning device 88, the secondary cleaning device 90, the tertiary cleaning device 92 and the quaternary cleaning device 94 sequentially for cleaning of the substrate while the substrate is kept held by the transport unit 96. The substrate after cleaning is returned by the first transfer robot 22 to the substrate cassette of the front loading portion 20.

On the other hand, the other substrate is taken by the first transfer robot 22 out of a substrate cassette mounted in one of the front loading portions 20, and the substrate is transported by the first linear transporter 62 and the second transfer robot 84 to the second linear transporter 74. The substrate is then transported by the second linear transported 74 to the substrate table 30*b* of the first polishing unit 24*b* of the two-step polishing unit 16 and held on the substrate table 30*b*. The first polishing step of the substrate is carried out in the first polishing unit 24*b*. The substrate after the first polishing step is reversed by the reversing/transferring machine 82 and placed on the pusher 78, and the substrate is then transported by the second linear transporter 74 to the top ring 54*b* of the second polishing unit 26*b* of the two-step polishing unit 16 and held by the top ring 54*b*. The second polishing step of the substrate is carried out in the second polishing unit 26*b*. The substrate after the second polishing step is transported by the second linear transporter 74 and the second transfer robot 84 to the reversing machine 86, where the substrate is reversed. The reversed substrate is transported to the primary cleaning device 88, the secondary cleaning device 90, the tertiary cleaning device 92 and the quaternary cleaning device 94 sequentially for cleaning of the substrate while the substrate is kept held by the transport unit 96. The substrate after cleaning is returned by the first transfer robot 22 to the substrate cassette of the front loading portion 20.

A polishing process according to the present invention, carried out by the first polishing unit 24*a* and the second polishing unit 26*a* of the two-step polishing unit 14, will now be described with reference to FIGS. 8A thorough 8D. FIG. 8A corresponds to FIG. 1; and in FIGS. 8A through 8D the same members or elements as those shown in FIG. 1 are given the same reference numerals and a duplicate description thereof will be omitted.

A substrate W is first transported to the first polishing unit 24*a*, where the first polishing step of the substrate is carried out by a small-size pad polishing method, meaning a method for polishing an object using a polishing pad having a smaller diameter (or radius) than that of the object. In particular, the substrate W, held with its front surface (surface to be polished) facing upwardly on the substrate table 30*a*, is rotated by rotating the substrate table 30*a*, and the polishing table 32*a* being rotated is lowered to press the polishing pad 124 of the polishing device 32*a* against the substrate W at a predetermined pressure, while at the same time a polishing liquid is supplied from the polishing liquid supply section 128 to between the substrate W and the polishing pad 124, thereby polishing the copper film 206 as an objective film formed in the surface to be polished of the substrate W. During the polishing, the polishing device 32*a* is pivoted along the radial direction of the substrate W so as to polish and flatten the entire surface of the substrate W.

Figure 8B:
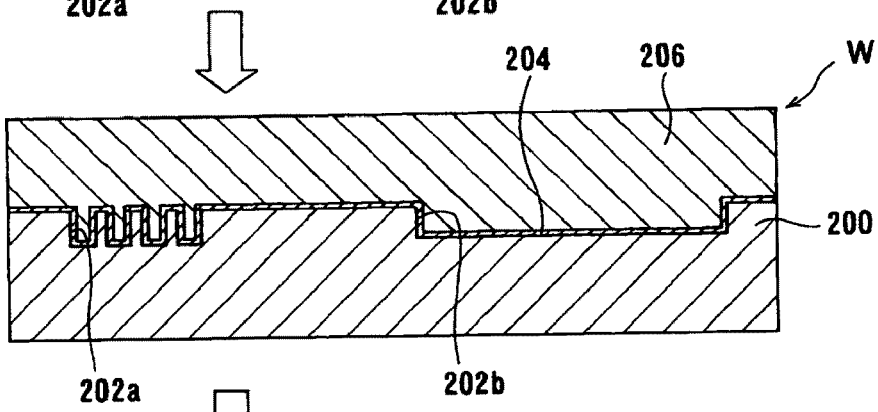

In the first polishing step by the first polishing unit 24*a*, the copper film 206 as an interconnect material, formed in the surface of the substrate W, as shown FIG. 8A, is polished to flatten the surface of the copper film 206, as shown in FIG. 8B. Thus, the first polishing step is terminated upon detection with the eddy current sensor 126 of a point in time when a surface level difference (irregularities) in the copper film 206 is eliminated to a targeted level or the surface of the film becomes flat with the progress of polishing.

In this embodiment, when the surface level difference in the copper film 206 becomes, e.g., 30-60 nm, it is determined that the surface level difference in the copper film 206 is eliminated or the surface of the film becomes flat. In a so-called BPSG (Boron Phosphor Silicate Grass) process (65 nm node), for example, when a surface level difference in an object becomes, e.g., 5-20 nm, it is determined that the surface level difference in the object is eliminated or the surface of the object becomes flat.

In the first polishing step by the small-size pad polishing method, the polishing pressure, i.e., the pressure of the polishing pad 124 on the substrate W, is made low (as compared to the second polishing step) and the relative speed between the substrate W and the polishing pad 124 is made high (as compared to the second polishing step). This makes it possible for the polishing pad 124 to hardly make contact with recessed portions of the copper film 206 even when the polishing pad 124 is a two-layer polishing pad, thereby effectively eliminating a surface level difference (irregularities) in the copper film 206. Though the use of a lowered polishing pressure leads to a lowered polishing rate and thus a lowered productivity, the use of a high relative speed between the substrate W and the polishing pad 124 can compensate for the lowering of the polishing rate.

By thus using the polishing device 32*a* having a diameter which is smaller than the radius of the substrate W and carrying out the first polishing step by pressing the rotating polishing pad 124 of the polishing device 32*a* against the rotating substrate W while pivoting the polishing device 32*a* in the radial direction of the substrate W, it becomes possible to make the area of contact between the substrate W and the polishing pad 124 small and to control with precision the pressure of the polishing pad 124 on the small area of the substrate W. In particular, the pressure of the polishing pad 124 on the substrate W can be more easily controlled at a low pressure. The polishing rate can be controlled with precision over the entire surface of the substrate W by changing the polishing pressure or the rotating speed of the polishing device 32*a* depending on the radial position on the substrate W. For example, it is possible to intensively polish only raised portions of the surface of the copper film 206, whereby the entire surface of the copper film 206 can be flattened with ease. Further, a polishing liquid can be effectively used by supplying the polishing liquid from the center of the polishing pad 124 to between the polishing pad 124 and the substrate W.

Thus, according to the first polishing step by the small-size pad polishing method, a surface level difference in the copper film 206 can be effectively eliminated with the progress of polishing.

The substrate W after the first polishing step is reversed by the reversing/transferring machine 72, and is then transported to the second polishing unit 26*a*, where the second polishing step is carried out by a conventional method. In particular, the turntable 130 is rotated and the top ring 54*a*, holding the substrate W with its front surface (surface to be polished) facing downwardly, is rotated and lowered to press the substrate W against the polishing pad 50*a* of the polishing device 52*a* at a predetermined pressure, while at the same time a polishing liquid is supplied from the polishing liquid supply nozzle 56*a* to the polishing pad 50*a*, thereby polishing the entire surface of the copper film 206 as an object film formed in the surface to be polished of the substrate W.

Figure 8C:
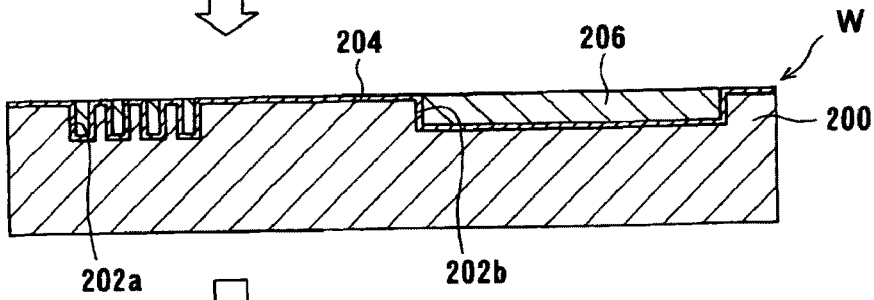
Figure 8D:
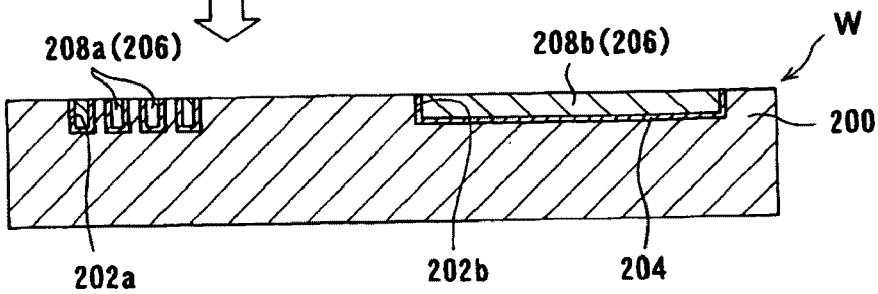

In the second polishing step by the conventional method, the copper film 206 whose surface has been flattened, as shown FIG. 8B, is polished uniformly over the entire surface to remove the extra copper film 206 other than copper embedded in the trenches 208*a*, 208*b*, as shown in FIG. 8C, and the extra barrier metal layer 204 on the insulting film 200 is also polished away, as shown in FIG. 8D, thereby forming fine copper interconnects 208*a* and wide copper interconnects 208*b*.

In the second polishing step by the conventional method, the polishing pressure, i.e., the pressure of the polishing pad 50*a* on the substrate W, is made high to achieve a high polishing rate. The relative speed between the substrate W and the polishing pad 50*a* is made low so as to prevent the polishing liquid, supplied onto the polishing pad 50*a*, from being forced out of the polishing pad 50*a* without contributing to polishing.

It will be disadvantageous to carry out second polishing of the copper film 206 by a method for polishing an object utilizing a smaller polishing pad than the object in diameter (radius) after terminating elimination of a surface level difference in the film in the first polishing step for the following reasons:

(1) Compared to the conventional method, the polishing rate in polishing as carried out by the small-size pad polishing method is low. This is because only a portion of a substrate is being polished at a certain moment in polishing by the small-size pad polishing method, whereas an entire surface of a substrate is always being polished in polishing by the conventional method.

(2) Compared to the conventional method, it is difficult with the small-size pad polishing method to continue polishing while maintaining the in-plane uniformity of a thickness of a film being polished. Since only a portion of a substrate is being polished at a certain moment in polishing by the small-size pad polishing method, a flatness of a film being polished, once attained upon elimination of an initial surface level difference, can be maintained with difficulty during the later polishing period. On the other hand, a flat film surface can be maintained more easily during polishing by the conventional method which uniformly polishes the entire surface of the film.

In this embodiment, therefore, the small-size pad polishing method is employed in the first polishing step to effectively eliminate a surface level difference (irregularities) in the copper film 206, and the conventional method is employed in the second polishing step to continue polishing after the elimination of the surface level difference. For example, taking the deepest dishing (recess) of the surface irregularities, formed in the copper film 206 before polishing, as a reference, the first polishing step is carried out and terminated at a point in time when the level of the entire surface of the copper film 206 reaches the level of the bottom of the deepest dishing, and then the second polishing step is carried out by the conventional method to polish away the copper film 206 while maintaining the flatness of the surface and also polish away the barrier metal layer 204.

By thus employing the small-size pad polishing method in the first polishing step and the conventional method in the second polishing step, it becomes possible to carry out polishing in such a manner as to utilize the respective advantages of the two polishing methods and make them compensate for each other's disadvantages. In particular, a surface level difference in the copper film can be effectively eliminated by the small-size pad polishing method which is excellent in the ability to eliminate a surface level difference in the film, and subsequently the remaining extra copper film 206 can be polished away by the conventional method which has a higher polishing rate than the small-pad polishing method and is excellent in the ability to polish the film while maintaining the flatness of the film surface.

In this embodiment, a point in time when a surface level difference in the copper film 206 is eliminated and the film surface becomes flat is detected based on measured values of the eddy current sensor 126 mounted in the rotary support 122 of the first polishing unit 24*a*.

In measuring the thickness of the copper film 206 with the eddy current sensor 126, change in the film thickness could be hard to detect until the polishing pad 124 comes into full contact with the copper film 206. The measured thickness of the copper film 206 as measured on a raised portion of the film greatly differs from the measured thickness of the film as measured on a recessed portion of the film. For example, when a film thickness of a raised portion of the copper film 206 is measured after measuring a film thickness of a recessed portion, an increase in the measured thickness can be detected despite the progress of polishing. After the polishing pad 124 has come into full contact with the copper film 206, the measured thickness of the copper film 206 will change according to the amount which had been polished. The time when processing of elimination of a surface level difference is to be finished can be monitored by detecting the shift in the change of the measured film thickness. Specifically, while the degree of decrease or increase in the thickness of the copper film 206 is being monitored, a point in time when the measured film thickness ceases to increase or change of film thickness disappears can be taken as the time of elimination of surface level difference. After confirming the platted status of change of the film thickness, it is possible to finish the first polishing process.

Complete removal of the extra copper film 206 other than copper embedded in the trenches 202*a*, 202*b* and complete removal of the barrier metal layer 204 on the insulating film 200 are detected with the eddy current sensor 132 mounted in the turntable 130 of the second polishing unit 26*a*.

A point in time when a surface level difference in the copper film 206 is eliminated to a targeted level may also be detected based on a change in a torque that rotates the polishing device 32*a* of the first polishing unit 24*a*. The change in the torque can be measured by a torque sensor.

In polishing of an object film having a surface level difference (irregularities), the polishing pad of the polishing device only partly makes contact with the object film at the start of polishing due to the surface level difference in the object film. The area of contact between the polishing pad and the object film increases as the surface level difference in the object film decreases, and there is no change in the contact area after the polishing pad has come into full contact with the object film. This is reflected in the torque of a spindle that drives the object. Thus, the torque gradually increases from the start of polishing until the polishing pad comes into full contact with the object film, whereas there is no change in the torque after the full contact of the polishing pad with the object film. A point in time when the surface level difference in the object film is eliminated to a targeted level can therefore be detected by detecting the change in the torque.

Compared to a conventional scroll polishing method known as a polishing method generally for use in a polishing step carried out after a polishing step that employs a large-diameter pad polishing method (see, e.g., Japanese Patent Laid-Open Publication No. 10-058317), the present invention is superior in ability of flattening a surface of the substrate (effective elimination of a surface level difference). A scroll polishing method is a two-step polishing method to carry out finish polishing at a lower speed and a lower polishing pressure than polishing by the conventional method in the secondary polishing process. Compared to the above-described small-diameter pad polishing method in the present invention, the scroll polishing method is not effective method in the ability to eliminate a surface level difference to a targeted level and is applied only to the case when the relative speed between a polishing pad and an object is slow. The small-diameter pad polishing method according to the present invention is therefore superior to the scroll polishing method in quick and reliable processing for elimination of surface level difference.

While the present invention has been described with reference to the embodiments thereof, it will be understood by those skilled in the art that the present invention is not limited to the particular embodiments described above, but it is intended to cover modifications within the inventive concept.

What is claimed is:

1. A method for polishing an object by pressing a polishing pad against a surface of the object while moving the polishing pad and the object relative to each other, said method comprising:

carrying out a first polishing step by pressing a polishing pad of a polishing device against the surface of the object at a first pressure while moving the polishing pad and the object relative to each other at a first relative speed, wherein the polishing pad used in the first polishing step has a diameter which is smaller than a radius of the object;

carrying out a termination step of terminating the first polishing step at a point in time when a surface level difference in the object is eliminated to a targeted level; and carrying out a second polishing step by pressing a polishing pad of a polishing device against the surface of the object at a second pressure which is different from the first pressure while moving the polishing pad and the object relative to each other at a second relative speed which is different from the first relative speed, wherein the polishing pad used in the second polishing step has a diameter which is larger than a diameter of the object.

2. The method according to claim 1, wherein the second pressure is larger than the first pressure, and the second relative speed is slower than the first relative speed.

3. The method according to claim 1, wherein the point in time when the surface level difference in the object is eliminated to a targeted level is detected based on measured values of an eddy current sensor provided in the polishing device for carrying out the first polishing step.

4. The method according to claim 1, wherein the point in time when the surface level difference in the object is eliminated to a targeted level is detected based on a change in a torque that rotates the polishing device for carrying out the first polishing step.

5. An apparatus for polishing an object, said apparatus comprising:

a first polishing unit having a polishing device having a diameter which is smaller than a radius of the object, the first polishing unit being capable of carrying out a first polishing step of pressing a polishing pad of the polishing device against a surface of the object at a first pressure while moving the polishing pad and the object relative to each other at a first relative speed;

a detecting instrument for detecting a point in time when a surface level difference in the object is eliminated to a targeted level; and a second polishing unit having a polishing device having a diameter which is larger than a diameter of the object, the second polishing unit being capable of carrying out a second polishing step of pressing a polishing pad of the polishing device against the surface of the object at a second pressure which is different from the first pressure while moving the polishing pad and the object relative to each other at a second relative speed which is different from the first relative speed.

6. The apparatus according to claim 5, wherein the second pressure is larger than the first pressure, and the second relative speed is slower than the first relative speed.

7. The apparatus according to claim 5, wherein the detecting instrument is an eddy current sensor.

8. The apparatus according to claim 5, wherein the detecting instrument is a torque sensor for measuring the torque of the polishing device of the first polishing unit.

* * * * *